United States Patent [19]

Martinval

[11] Patent Number: 4,853,982

[45] Date of Patent: Aug. 8, 1989

[54] TOILET APPARATUS WITH DEVICE FOR WASHING, DISINFECTING AND DRYING TOILET SEATS

[76] Inventor: Andre Martinval, 22 D rue du Trey, Le Parc Buffon, Besancon, Doubs, France

[21] Appl. No.: 71,547

[22] Filed: Jul. 7, 1987

[30] Foreign Application Priority Data

Jul. 11, 1986 [FR] France ..... 86 10714

[51] Int. Cl.[4] ..... A47K 13/00

[52] U.S. Cl. ..... 4/233

[58] Field of Search ..... 4/233, 662

[56] References Cited

U.S. PATENT DOCUMENTS

| | | | |
|---|---|---|---|
| 1,877,689 | 9/1932 | Peterson | 4/233 |
| 4,692,951 | 9/1987 | Taki et al. | 4/662 X |
| 4,734,942 | 4/1988 | Blanchard | 4/233 |

FOREIGN PATENT DOCUMENTS

| | | | |
|---|---|---|---|
| 0059134 | 9/1982 | European Pat. Off. | 4/662 |
| 0092481 | 10/1983 | European Pat. Off. . | |
| 2344261 | 10/1977 | France | 4/233 |
| 2543594 | 10/1984 | France . | |
| 2580310 | 10/1986 | France | 4/233 |

*Primary Examiner*—Charles E. Phillips
*Attorney, Agent, or Firm*—Browdy and Neimark

[57] ABSTRACT

An apparatus for cleaning and disinfecting a toilet seat. The apparatus comprises a chamber housing a water flushing tank and a tank of disinfecting and cleaning product, means for removing a used seat and replacing this used seat with a clean, disinfected seat, this means comprising two endless chains driven by an electric drive motor and to each of which each seat is connected by its back edge. Rails are provided for guiding the seats along their travel in the chamber. Means are provided for automatically controlling the opening of a door allowing the seats to pass into the chamber. The seats are washed by means of a spraying ramp inside the chamber. Locking means are provided on the door and chamber to assure locking of the door in a closed position. A seal is inserted between the door and the chamber, which locking means can be neutralized by associated unlocking means carried by at least one of the chains, at the beginning of the cleaning cycle, while crushing the seal permits the door to be locked.

18 Claims, 7 Drawing Sheets

TOILET APPARATUS WITH DEVICE FOR WASHING, DISINFECTING AND DRYING TOILET SEATS

FIELD OF THE INVENTION

The present invention relates to a toilet apparatus including a device for cleaning toilet seats, i.e., an apparatus in which each east is replaced by a cleaned, disinfected and dried seat after each use.

BACKGROUND OF THE INVENTION

This apparatus is of the type in which there is provided at the back and above the bowl a box comprising besides a water tank for flushing of the toilet and a tank of disinfecting and cleaning product, a mechanism for removing the seat that has just been used and replacing it with a clean, disinfected seat, this mechanism essentially comprising two endless chains or the like with which is associated an electric drive motor, each seat is connected by its back edge to the two endless chains. Means are provided for guiding the seats along their travel in the box, and means are provided for automatically controlling the opening of a door allowing the passage of the seats as well as means for washing of each seat brought into the box comprising especially a spraying ramp placed inside the box.

Such an installation is already known from previous French Pat. No. 85 06175 in the name of the applicant.

In this known apparatus, driving of the endless chains and opening of the door are performed by two different motors, which obviously complicates the apparatus and makes it more expensive. Further, no means for locking the door in closed position is provided, so that water can flow out through it to the outside of the apparatus during the cleaning process.

SUMMARY OF THE INVENTION

The object of the invention therefore is to remedy these drawbacks and to provide a toilet installation in which the door provided at the front of the box is locked tight in the closed position and can be opened automatically when the cleaning cycle begins.

Another object of the invention is to provide means making it possible to use water from the regular water main, while maintaining a sufficient pressure to permit an effective cleaning of the seats.

For this purpose, in a toilet apparatus according to the invention, which is of said type, locking means are provided on the door and box to assure locking of the door in the closed position, a seal being inserted between the door and box. The locking means can be neutralized, at the beginning of the cleaning cycle, by associated unlocking means carried by at least one of the chains.

Means for locking the door are advantageously formed by a least one hook mounted on the door and at least one bolt mounted to rotate on the box and capable of swinging out of its engagement position in the hook by a lug fastened to the chain.

Means are also provided to control the opening of the door and to lock it in the open position. These means comprise at least one bent rocker coupled by one of its ends and by means of a rod to the upper edge of the door, mounted to pivot around a median axis, and whose other end is acted on by a cam, this rocker being able to make the door pivot upward when it is acted on by a profile of the cam and a catch intended to work with a part of the rocker to lock it in the door opening position.

Thus, installation operates with only a single electric motor, which assures driving of the seat transfer chains.

To have a maximum water pressure during the cleaning cycle, it is also provided, according to the invention, that filling of the flushing water is controlled by a flow regulator which prevents too great a pressure drop from harming the efficiency of the washing of the seats.

In any case, the invention will be better understood and other characteristics will be brought out with the help of the following description with reference to the accompanying diagrammatic drawing representing by way of nonlimiting example a preferred embodiment of this toilet installation:

DETAILED DESCRIPTION OF THE INVENTION

Figure 1:
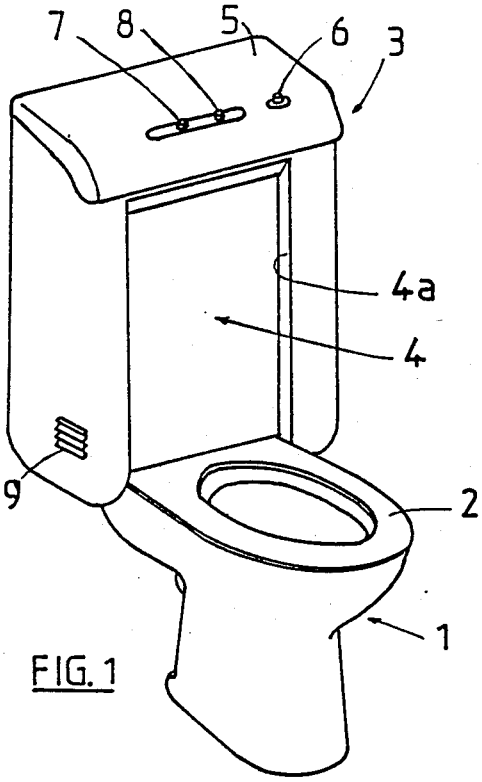
FIG. 1 is a perspective view.

As FIG. 1 shows, the toilet installation according to the invention comprises essentially a bowl 1 forming a stool and provided with a seat 2, as well as a chamber 3 located at the back and above bowl 1.

The chamber 3, which is preferably made of injected plastic, comprises a front door 4 which exhibits an indentation 4*a* making it possible vertically to lift seat 2 placed on the stool, which facilitates maintenance of bowl 1. This box 3 is also provided in its upper part with a closing lid 5 which pivots forward and whose opening allows access particularly to the tank of disinfecting and cleaning product.

On lid 5 are placed a cycle trigger button 6 and two lights 7,8, green and red respectively, whose role will be explained more in detail below.

Box 3 further exhibits at the bottom of its lateral sides aeration louvers 9.

Figure 2:
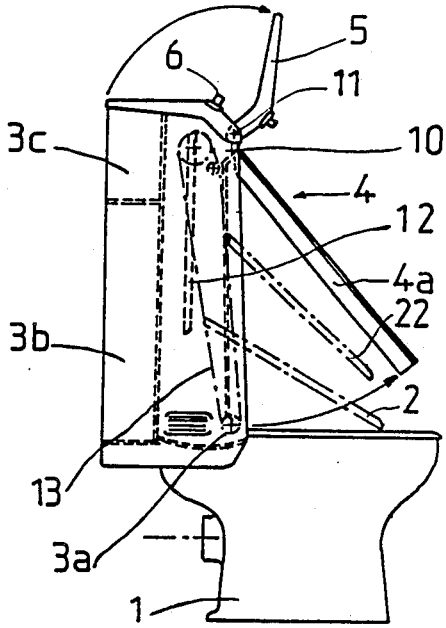
FIG. 2 is a side view illustrating the various positions taken by the seats during the cleaning cycle.

As shown particularly in FIG. 2, front door 4 of the chamber is articulated by its upper end at 10 on the front face of chamber 3 and lid 5 is also articulated on the front face of chamber 3 at articulation point 11 close to that of door 4.

This FIG. 2 shows the different positions of seat 2 during the cleaning cycle: by 2 is indicated the seat leaving the toilet stool to be cleaned inside the box, by 12 the seat during cleaning and drying inside this chamber 3, and by 22 the seat clean and dry, which has just been put in place onto bowl 1. Actually, the apparatus comprises 2 seats which are fastened at regular intervals on two endless drive chains 13 placed on each of the sides of chamber 3.

In this FIG. 2, it can also be seen that chamber 3 is subdivided on the inside into 3 main compartments 3*a*, 3*b*, 3*c*, a compartment 3*a* at the front of the chamber for cleaning and drying of seats 2, 12,22, a compartment 3*b* for the tank of flush water and disinfectant product and a compartment 3*c* containing the elements for controlling the cleaning cycle and driving of the seats.

Figure 7:
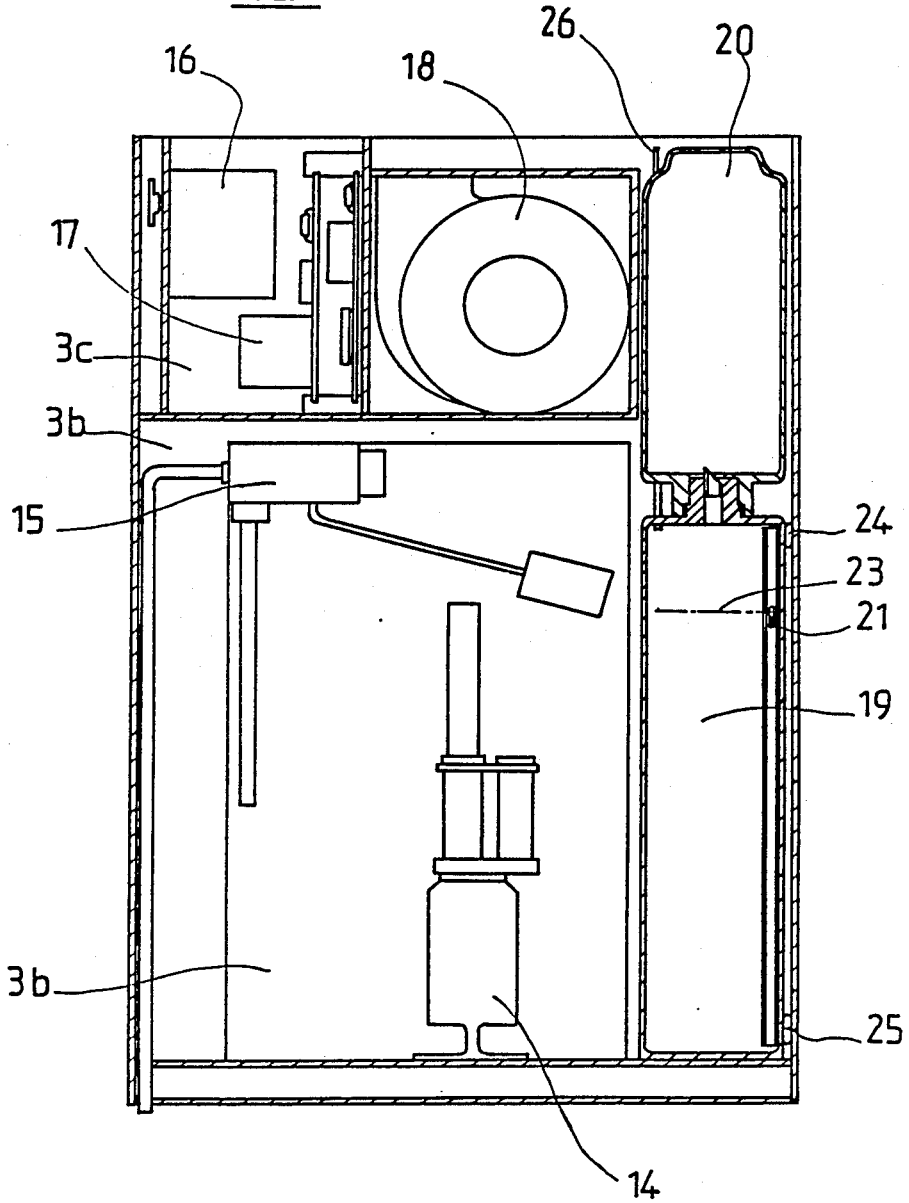
FIG. 7 is a view in section along VII—VII of FIG. 3 of the box.

As FIG. 7 shows more particularly, compartment 3*b* constitutes a water tank inside of which are a water flushing system 14 with electromagnetic control and a float filling system 15 of the types known in the art.

In compartment 3*c* are placed a transfer motor 16 which controls the rotation of the endless chain 13 as well as the electronic circuit and in particular a control card 17 of the motor and cleaning operation, which controls starting and/or stopping of the motor as well as course of the cleaning cycle. This compartment 3*c* is quite obviously watertight.

On the side of compartment 3*c*, in another compartment, is an impeller type centrifugal fan 18 which, preferably, is equipped with a heating element and whose role is to accelerate the drying of seats 2, 12, 22 which have just been cleaned.

In the remaining space of chamber 3 are further placed a tank 19 of cleaning and disinfecting product and a refill 20 of this product, which is screwed onto the upper end of tank 10 and therefore can be changed and replaced by a new refill in case of need.

As particularly shown in this FIG. 7, access from above to refill 20 can be achieved particularly by the opening of lid 5.

In tank 19 of the disinfecting product is further placed a magnetic float 21 which follows level 23 of the product in this tank and works with two magnetic sensors 24, 25 placed at the top and bottom of tank 19 to indicate the level of product 23 in the tank.

The electronic circuit associated with the sensors 24, 25 is designed so that, when float 21 is distant from first high level sensor 24, a blinking of green light 7 occurs which is normally lit continuously as soon as the installation is ready for operation. Its blinking indicates that refill 20 is empty.

Red light 8 is normally lit continuously during the entire operating cycle of the installation, i.e., when green light 7 goes out.

When float 21 approaches low level sensor 25, a blinking of red light 8, placed on the chamber occurs, this blinking indicating the absence of disinfecting liquid and corresponding to putting the apparatus out of service so as not to perform the cleaning cycle without cleaning product.

Tank 19 also comprises an open air vent 26 making a good flow of the product possible.

Figure 3:
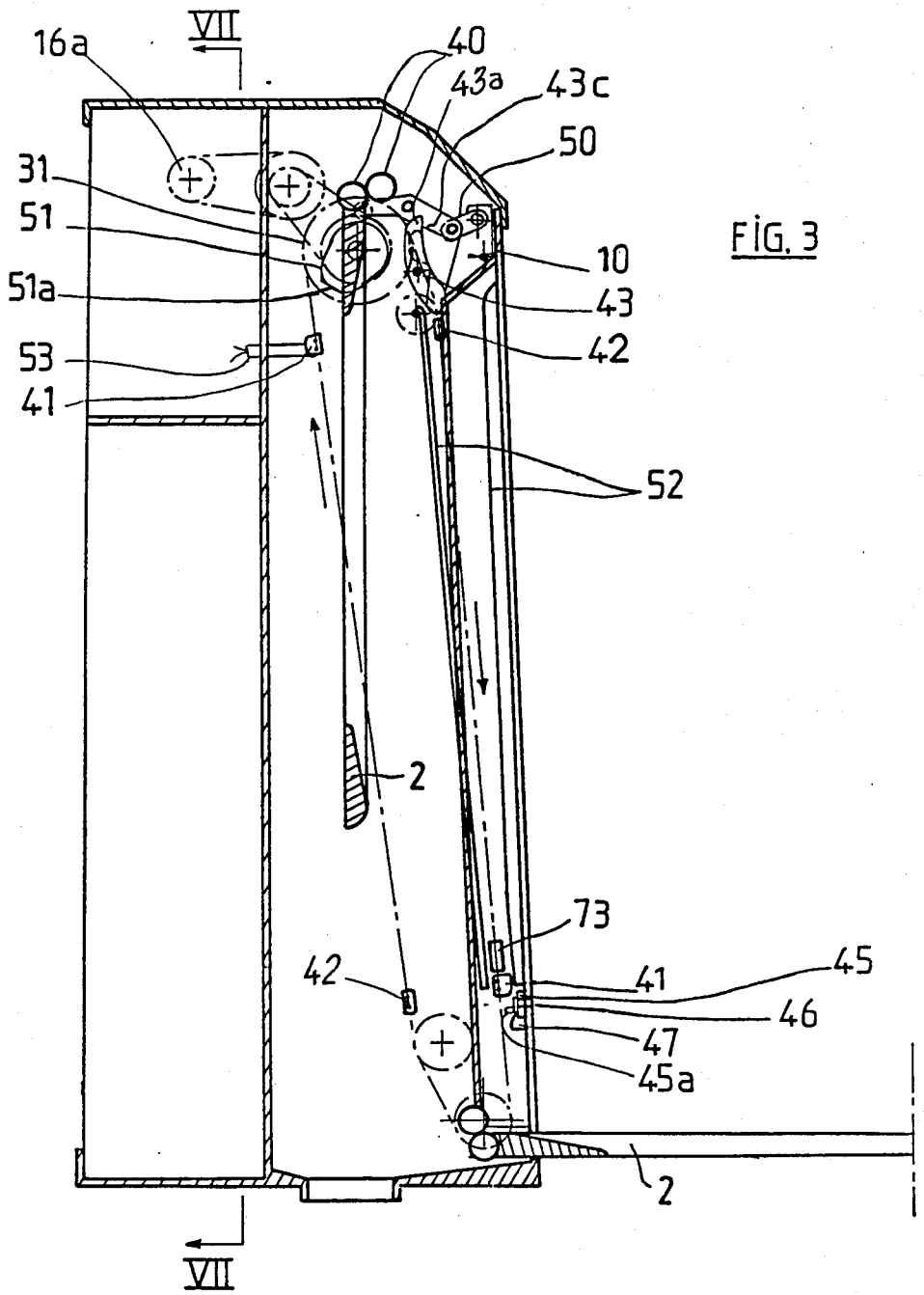
FIG. 3, on an enlarged scale, is a view in longitudinal section of the installation box, showing the seat driving system, the door being closed and the seat cleaning system not being represented.
Figure 4:
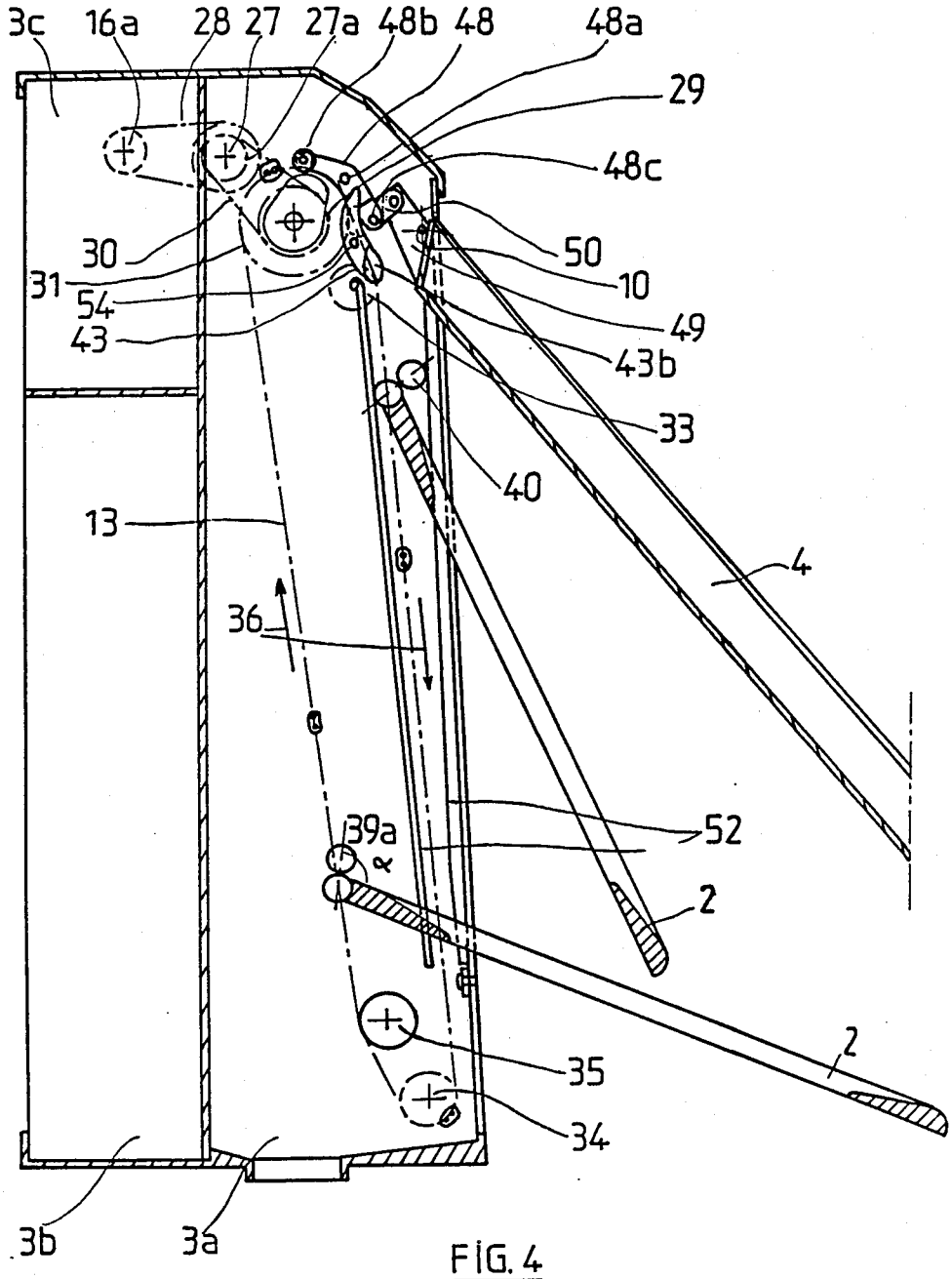
FIG. 4 is a view similar to FIG. 3, the door being open.

FIGS. 3 and 4 illustrate the principle of opening and closing of front door 4.

Output shaft 16*a* of transfer motor transmits its rotation movement to a transmission shaft 27 by a chain 28. This transmission shaft 27, by two pairs of gears 27*a*, 29 and chains 30, drives two gears 31 placed laterally, i.e., on each of the sides of chamber 3.

The description will relate to only one side (the right) of the apparatus; however, the same operations of course, are performed symmetrically on each of the sides of the apparatus.

Gear 31 drives endless chain 13 is rotation, the latter describing its movement around a pad 33, pinion 34 and tension roller 35. Arrows 36 indicate the direction of rotation, which is clockwise, of this chain 13.

The two seats 2 are fastened at an equal distance from one another on chain 13.

Figure 6:
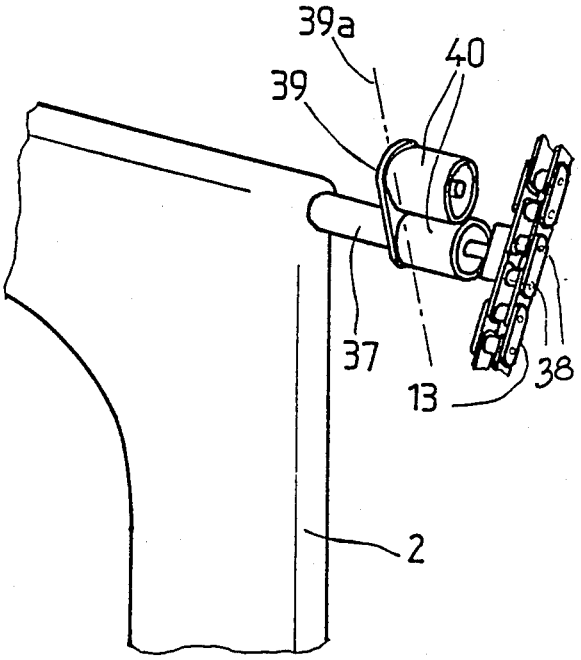
FIG. 6 is a detail view, in perspective, showing the fastening of a seat to a drive chain.

Thus, as FIG. 6 shows, each of these seats 2 is provided laterally, on its back edge, with two pins 37 (only one of which is represented in FIG. 6) each permitting its hooking at two articulation points 38 of the links of one of chains 13.

In this way, each seat 2 can pivot freely around its articulation pin 37 on chain 13.

Further, on each pin 37 is fastened a support 39 which consequently is solid with seat 2 and which carries two rollers 40 mounted to rotate on this support 39.

These two rollers 40 are intended to work with guide rails 52 placed in the front part of box 3, when the seat descends again after it has been cleaned.

As FIG. 4 show in particular, rails 52 are at a variable distance from one another and longitudinal axis 39*a* of each support 39 makes an angle of about 118° with the plane of associated seat 2, which makes it possible to cause a gradual inclination of seat 2 which comes out and to keep it from hitting door 4 or seat 2 which comes back during its exit.

Each chain 13 also exhibits two lugs 41 for unlocking of door 4 and two lugs 42 for unlocking of a catch 43 which assures holding of door 4 in open position, these lugs 41,42 being alternately distributed along each chain 13.

Locking of door 4 in closed position is assured, on each side of chamber 3, by a bolt 45 which pivots around a horizontal pin 46 fastened to the wall of chamber 3 (cf. FIGS. 3 and 5) and which is able to engage in a hook 47 placed along indentation 4*a* of door 4.

Each bolt 45 is further provided with a projection 45*a* able to work with one of lugs 41 to cause bolt 45 to pivot upward and release hook 47. To improve the efficiency of lug 41, at the level of bolt 45, chain 13 is supported by a guide 73.

Locking of door 4 in open position is assured on each side of the chamber with a catch 43 and a bent rocker 48, mounted to pivot around a median axis 48*a*, fastened to the inside wall of box 3. Bent rocker 48 carries, at one of its ends, a roller 48*a* which travels on a cam 51, while its other end is articulated, by a rod 50, at upper end 49 of the door, which is articulated at 10 on the lateral wall of the chamber.

Catch 43 is mounted to pivot around its horizontal pin 54 and is designed to rest vertically under the effect of its own weight, as shown in FIG. 4 in the absence of any pull.

This catch 43 exhibits, at its upper part, a recess 43*a* which works with a boss 48*c* made laterally on bent rocker 48 to lock it in open position of door 4; it also exhibits in its lower part a projection 43*b* which works, by its practically vertical internal side, with one of lugs 42 of chain 13, this lug causing the counterclockwise swinging of catch 43 and its disengagement from rocker 48 to allow closing of door 4.

The presence of pad 33 at this place permits a better holding of chain 13 and lug 42 when the latter acts on projection 43*b* of catch 43.

Bent rocker 48 is further acted on by approximately egg-shaped cam 51, which is solid in rotation with gear 31 and which makes three revolution while chain 13 makes a half-revolution which corresponds to a transfer cycle, i.e., the exchange of two seats.

By its profile 51*a*, this cam 51 makes bent rocker 48 swing clockwise (cf. FIG. 4) to cause opening of the door by rod 50.

Therefore opening and closing of door 4 are performed as follows:

At the beginning of the cycle (cf. FIG. 3), door 4 of chamber 3 is closed and locked by bolts 45 of the chamber engaged in associated hooks 47 of the door, a seal (not shown in the drawing) placed along the edge of door 4 and compressed between it and the outside wall of chamber 3 assuring the sealing.

In this position, when the control button 6 starts motor 16, chain 13 begins to turn in the direction of arrows 36.

Figure 5:
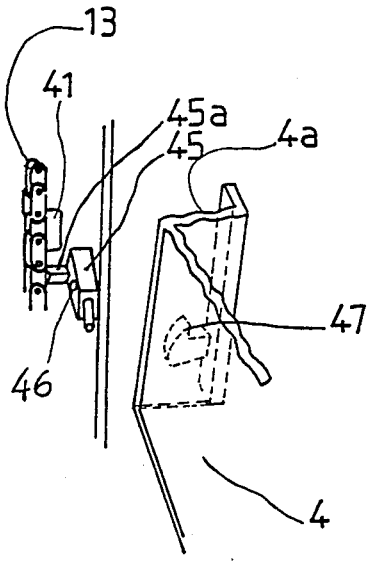
FIG. 5 is a detail view, in perspective, of the door locking mechanism in closed position.

One of lugs 41 then comes to strike against projection 45*a* of bolt 45, the latter pivots around its pin 46 and disengages from hook 47 of the door (cf. FIG. 5).

Instantaneously, because of the elasticity of its seal, door 4 is slightly separated from box 3, which prevents bolt 45 from again engaging in hook 47 as soon as lug 41 leaves it and guarantees unlocking of door 4, the latter still being lowered. It will be noted that this fraction of movement intervenes on the portion of cam 51 with constant radius.

As it rotates, cam 51, by its cam profile 51*a*, causes the clockwise swinging of bent rocker 48 and opening of door 4 by rod 50 (cf. FIG. 4).

The maximum opening of door 4 is attained on cam portion 51*a* exhibiting the largest common radius shown in FIG. 4. In this portion, catch 43 pivots under the effect of its own weight and comes to be hooked by its recess 43*a* against boss 48*c* of the rocker.

At this moment, door 4 is locked in open position and does not reclose during a further rotation of cam 50.

Closing of the door is obtained when seats 2 have been exchanged, i.e., when chain 13 has made a half-revolution, thanks to one of lugs 42, which by coming to rest against projection 43*b* of the catch, causes the counterclockwise rotation of the latter and, consequently, the freeing of bent rocker 48.

Door 4, then freed, falls under the effect of its own weight, and is automatically locked by hooks 47 which engage with bolts 45.

On the inside of chamber 3 is also an electromagnetic sensor 53, of the type known under the tradename ILS 30, which is connected to a power relay (not shown in the drawing) mounted on control card 17 and which works with a permanent magnet fastened to lugs 41 to cause stopping of motor 16. This electromagnetic sensor 53 is placed so as to be activated at the end of seat transfer cycle and therefore causes stopping of motor 16 at the end of this cycle.

Figure 8:
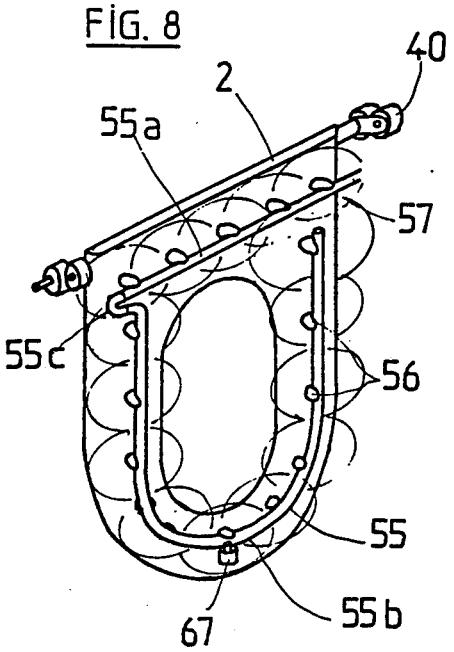
FIG. 8 is a view, in perspective, of the spraying and cleaning ramp.
Figure 9:
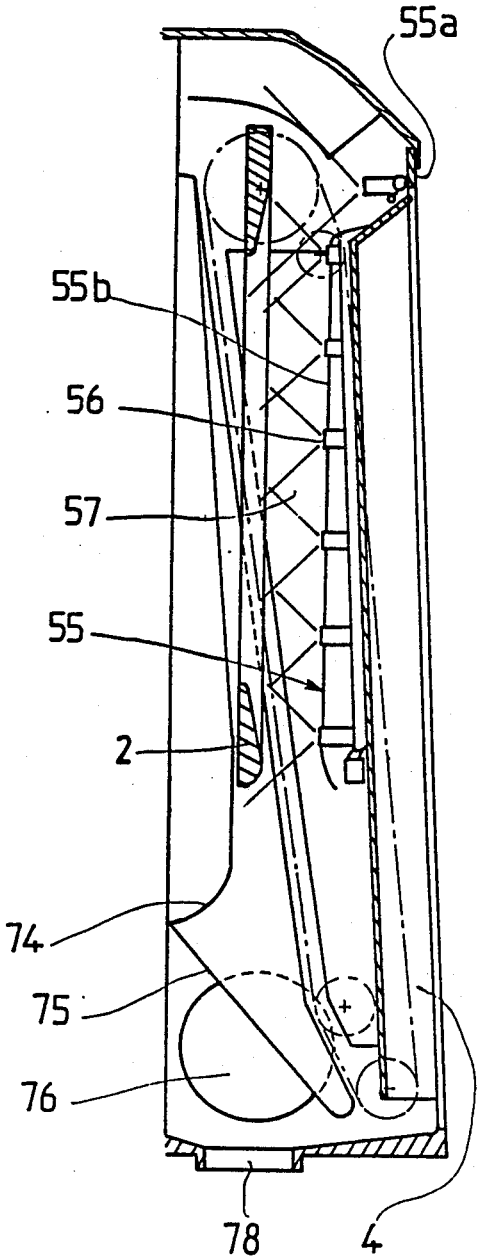
FIG. 9 is a views in longitudinal partial section of the box without the seat driving system.
Figure 10:
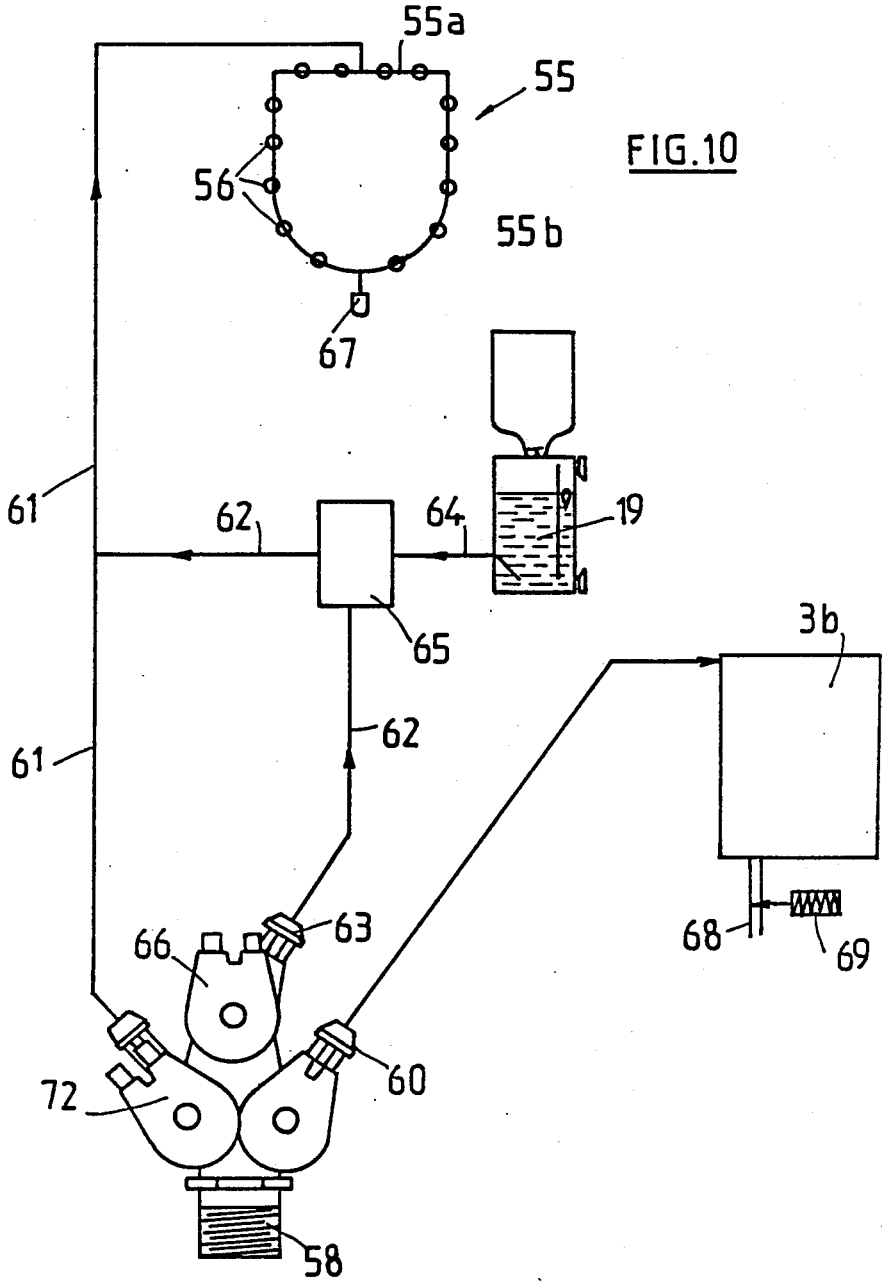
FIG. 10 is a diagrammatic view of the hydraulic installation.

FIGS. 8 and 9 show the device for cleaning of seats 2, FIG. 10 being a diagram of the hydraulic circuit of this device.

As FIGS. 8 and 9 in particular show, this circuit is made up of a spraying ramp 55 placed vertically on the inside of box 3, and whose form corresponds to that of seat 2.

This ramp 55 is made up of a horizontal part 55*a* fastened to box 3 and a U-shaped part 55*b* fastened to door 4, these two ramp parts being connected together by a flexible connection 55*c*.

This ramp 55 has approximately the shape of a U closed on itself.

It comprises, at regular intervals, nozzles 56 for spraying of the cleaning product. Each of these nozzles 56 is designed to deliver a jet 57 in the form of a solid cone (cf. FIGS. 8 and 9), to cover the total surface of seat 2 and consequently to assure a perfect cleaning of the latter.

As FIG. 10 shows, feeding of ramp 55 is performed from a water feed tank of which only connecting part 58 is represented in this figure. Three pipes go out from this connecting part 58, namely:

a pipe 59 controlled by a pressure reducer valve 60 and connecting water flush tank 3*b* to the water main, a pipe 61 for direct feeding of water to ramp 55, controlled by an solenoid valve 72, and a pipe 62 connected to said pipe 61 through a venturi device 65 whose suction orifice is connected to tank 19 of the cleaning product by a pipe 64. This pipe 64 is controlled, upstream, by a solenoid valve 66 followed by a flow reducer 63.

Venturi device 65 is designed to create, at the level of the connection of pipes 62 and 64, a depression which causes suction of the cleaning product when duct 62 is fed water as a result of opening of solenoid valve 63, as more fully explained in said French Pat. No. 85 06175 in the name of the applicant.

A purge valve 67 is provided at the lower end of spraying ramp 55 to allow it to be purged in the case of lack of feed water pressure.

The operating cycle of the apparatus according to the invention, as described above and illustrated in FIG. 11, is the following:

At the beginning of the cycle (cf. FIG. 3), door 4 of chamber 3 is closed and locked, one of seats 2 is in place on bowl 1 of the apparatus, while the other is suspended vertically from 13, practically at the top of gear 31, i.e., at the top dead point of the system. Green light 7 is lit, while red light 8 is out.

Pressing on control button 6 (time $t_0$ in FIG. 11) causes turning off of green light 7 and lighting of red light 8 and, simultaneously, opening of solenoid valve 69 which controls the flow of the water contained in tank 3*b* through pipe 68 which connects this tank to the bowl of the apparatus.

Simultaneously or, optionally, after slight delay, i.e., at time $t'_0$, motor 16 is started.

As explained above, starting of motor 16 controls unlocking and opening of door 4 as well as a first cycle of transport and exchange of seats 2 and closing of door 4, at the end of this transfer cycle.

The end of this cycle of transfer of seats 2, which is performed over three revolutions of cam 51 and a half-revolution of chain 13, is detected by one of lugs 41 of chain 13 which, as explained above, comes to activate sensor ILS 53. This detection causes stopping of motor 16 at time $t_1$.

As in standard apparatus, emptying of flush water tank 3*b*, by the drop of its float, causes the order for a new refilling through flow regulator 60 and pipe 59.

Consequently, filling of flush water tank 3*b* does not extend the unavailability time of the apparatus, and the presence of flow regulator 60 has the effect of avoiding a water pressure drop which would be done to the detriment of washing seats 2 which is performed in the way described below.

Said stopping of motor 16 causes starting of the cycle of cleaning and disinfecting of seat 2 which has just been brought inside of the chamber 3.

This cleaning cycle begins by opening of solenoid valve 72 controlling the distribution of water to ramp 55 through pipe 61, thus achieving a sort of prewashing. Opening of solenoid valve 72 is produced, for example, at time $t_2$ and it continues to time $t_3$ of closing of this solenoid valve 72. Simultaneously with the closing of solenoid valve 72 the opening of solenoid valve 66 is ordered which controls the circulation of water in pipe 62 and in venturi system 65. Regulator 63, placed upstream from pipe 62, has the object of making it possible to meter at will the amount of product introduced into the water flow which goes through pipe 62 and, consequently, to assure that the desired metering is observed. Solenoid valve 66 remains open to time $t_4$, the period of its opening being established as a function of the amount of cleaning or disinfecting product it is desired to spray against seat 2 during cleaning.

The presence of flow regulator 63 and venturi device 65 obviously causes pressure drops which reduce the pressure of the flow of mixture delivered by pipe 62 in pipe 61, preventing this mixture from being satisfactorily sprayed against seat 2 during washing. To remedy this, simultaneously with closing of solenoid valve 66, opening is ordered, for a very short time, i.e., up to time $t_5$, of solenoid valve 72, this opening having the effect of making it possible to send a water flow at full pressure into pipe 61 and thus to drive the premetered mixture of product and water, which was previously in the downstream part of this pipe 61, and to assure spraying under full pressure against seat 2.

Simultaneously with the second closing of solenoid valve 72, i.e., at time $t_5$, feeding of drying fan 18 is ordered, this feeding being maintained up to time $t_6$ which represents the end of the cycle. At time $t_6$, the cycle being completed, red light 8 is put out and green light 7 is lighted.

Figure 11:
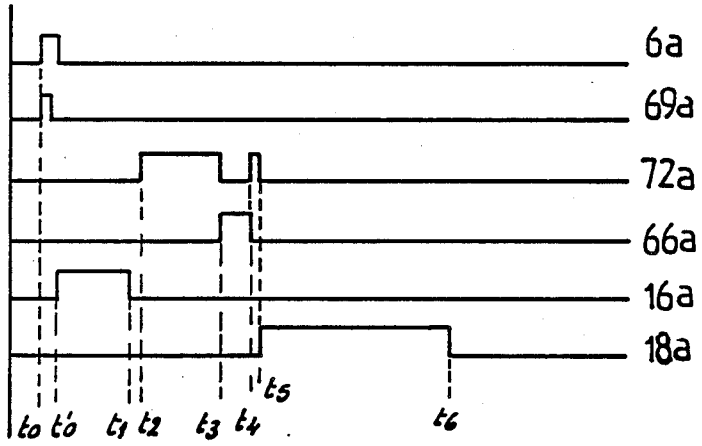
FIGS. 11 and 12 show two possible diagrams of the cleaning cycle.

The operating flow chart of the apparatus is represented in the diagram of FIG. 11, i.e., the various operating diagrams of the elements of this apparatus, as just described, and each diagram is designated by reference of the element concerned to which the indicator a has been added.

For this reason, in diagram **6*a* of the control button for starting the apparatus are found, 69*a* of solenoid valve 69 of the flush water, 72*a* of washing solenoid valve 72, 66*a* of solenoid valve 66 controlling the ejection of the mixture in the direction of ramp 55, 16*a* of motor 16 and 18*a* of fan 18**.

In the example shown in FIG. 11, between time $t_0$ or time $t'_0$ and $t_1$, 8 seconds pass as between time $t_2$ and $t_3$. Between time $t_3$ and $t_4$, only 1 second passes and between time $t_4$ and $t_5$, 0.5 second.

The operating time from $t_5$ to $t_6$ of fan 18 was established at 3 minutes, considering that this period of operation is sufficient, particularly when fan 18 is equipped with a heating element.

It should be noted that if a user exerts one or more other pressures on starting button 6, this action will have the effect only of ordering one or more new openings of solenoid valve 69 which controls the flow of the flush water but obviously has no influence or impact on the course of the cycle of transferring and cleaning of seats 2 which, from instant $t_0$, is controlled only by electromagnetic card 17.

Figure 12:
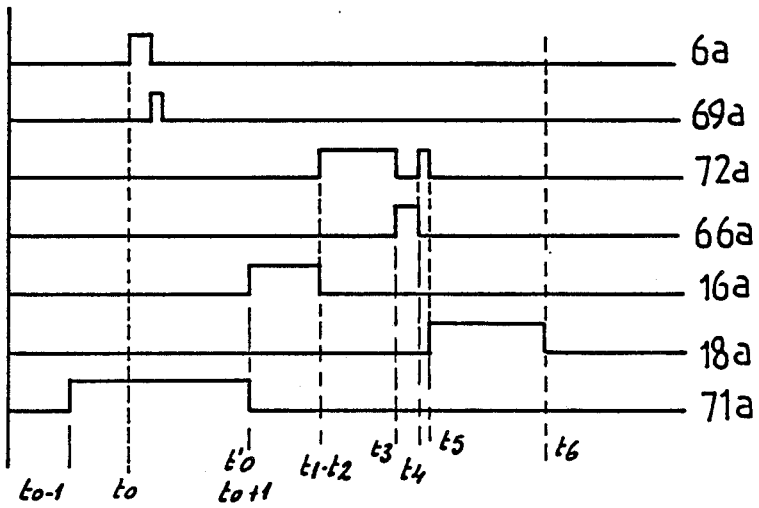

FIG. 12 shows another flow chart of the operation of the apparatus which can be used in this apparatus for better control of the operation. This flow chart, in which the various diagrams of various elements are designated by the same reference numbers as in FIG. 11, provides an additional element not mentioned before. With this apparatus is associated an optoelectronic cell, placed to detect the presence of a user placed at least a meter from the apparatus, for example by reflecting an infrared signal.

As shown by diagram **71*a* of FIG. 12, the presence of a user in the forbidden area between time $t_0-1$ and time $t_0+1$ (which obviously coincides with time $t'_0$ of starting motor 16) prevents starting of motor 16. The presence of this user during the operation of the installation will have the effect of stopping the operation of motor 16** until the departure of this user, the cycle then continuing when the user again moves away from the apparatus. In this case, this cell constitutes only a safety element for persons using the apparatus.

The presence of this cell can also be used profitably to eliminate the drawback of a user who would be obligated to act on control button 6 to start the apparatus so that detection of the departure of this user would by itself order the beginning of the entire cycle, including opening solenoid valve 69 which controls the operation of the flush water.

Instead of an optoelectronic cell, it would be possible to provide a switch associated with the closing lock of the door providing access to the apparatus and would allow operation of the latter only after opening of this lock. It would also be possible to provide that the switch associated with the lug quite simply replaces control push button 6 of the apparatus.

To eliminate the drawbacks due to a possible failure or interruption of the electric power, this apparatus is also equipped with a manual control lever of the flush water which, under such circumstances, controls its operation instead of solenoid valve 69.

In FIG. 3 is shown only passage hole 70 made in the lateral wall of chamber 3 for passage of this control lever.

Although not shown in the drawing, there are provided, in chamber 3, protective housings of chains 13, 28 and 30 as well as means making it possible to regulate the tension of chains 28 and 30, for example, by intermediate pin 27 on adjustable bearings crosswise along the corresponding lateral partition of chamber 3.

Moreover, motor 16 is advantageously a gear motor with mechanical brake, and means for taking up the slack of chains 13, 28 and 30 contribute to allowing an exact positioning of seat 2 placed on bowl 1.

It is also possible to add to the interstices existing between door 4 and the corresponding opening of chamber 3 flexible spray protectors which can prevent spraying of the washing water on the back part of seat 2 placed on bowl 1, without preventing the transfer of seats 2.

Of course, a high-pressure pump could also be provided to bring water to the spraying ramp, and at that moment filling of flush water can be performed simultaneously with the cleaning.

It is also possible to envisage cleaning and disinfecting of bowl 1 by integrating in the latter a ramp of nozzles controlled by a solenoid valve, the nozzles directing a jet of water and disinfecting product at predetermined sensitive spots.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology employed herein is for the purpose of description and not of limitation.

What is claimed is:

1. A toilet apparatus with a device for washing, disinfecting, and drying the toilet seat comprising:

a toilet having two seats, a chamber, and a bowl located below said chamber;

said chamber including a flushing water tank, a disinfecting tank, and a means for removing one seat after use and replacing the used seat with the other seat;

said means comprising two endless chains, a drive motor for driving said chains, said chains connected to each seat at the back edge thereof;

rails for guiding the seats along their travel in the chamber;

means for controlling the opening of a door in the chamber through which the seats pass;

means inside the chamber for washing each seat;

said means for washing comprising a spraying ramp inside the chamber;

locking means on the door and the chamber to lock the door in the closed position;

a seal inserted between the door and the box;

unlocking means to neutralize said locking means carried on at least one chain wherein said means to control opening the door and to lock the door in the open position comprise at least one bent rocker having a first end and a second end;

said rocker being coupled by the first end by means of a rod to the upper edge of the door and mounted to pivot around a median axis;

a cam acting on the second end of said rocker;

said rocker being adapted to make the door pivot upwardly when acted on by a profile of said cam;

a catch working with a part of said rocker to lock it in the door opening position.

2. The apparatus of claim 1, wherein the means for locking the door in the closed position are formed by at least one hook mounted on the door and at least one associated bolt on the chamber, and a pointer fastened to at least one chain to swing said bolt out of engagement with said hook.

3. The apparatus of claim 1 wherein the profile of each seat is designed to facilitate the flow of water and prevent catching of drops of water.

4. The apparatus of claim 1 wherein a catch having a horizontal pin is mounted to pivot around the horizontal pin and rests vertically under the effect of its own weight.

5. The apparatus of claim 4 wherein each chain has at least one lug which swings the catch out of engagement with the rocker by working with a projection on the catch.

6. The apparatus of claim 1 wherein each of the seats is provided laterally with two pins each permitting its hooking at two articulation points on the links of one of the chains;

each pin is fastened to a support carrying two rollers mounted to rotate, and a longitudinal axis of each support makes an angle of about 118° with the plane of the seat with which it is associated, thereby causing a gradual inclination of the seat in the guide rails.

7. The apparatus of claim 1 wherein the cleaning means comprises a spraying ramp placed vertically on the inside of the chamber;

the form of the spraying ramp corresponds to the form of the seat;

said ramp comprising a horizontal ramp fastened to said chamber and a U-shaped ramp fastened to said door, said two ramps being connected together by at least one flexible connector;

said ramp provided with nozzles for spraying of cleaning product to deliver a jet in the form of a solid cone to cover the total surface of the seat.

8. The apparatus of claim 7 comprising a first pipe connecting the ramp to a water main;

a prewashing solenoid valve controlling said first pipe;

a second solenoid valve and a pressure regulator controlling a second pipe for conducting cleaning product;

a removal device in said tank for removing cleaning product through said second pipe;

means for successively controlling the opening of the prewashing solenoid valve and simultaneously opening the second solenoid valve and simultaneously opening a third solenoid valve to control the distribution of water in a pipe to drive the cleaning mixture from nozzles on the ramp.

9. The apparatus of claim 8 wherein the device for removing the cleaning product in the tank comprises a venturi device having a suction orifice, and a pipe connecting said suction orifice to said tank.

10. The apparatus of claim 7 wherein a ramp of nozzles is provided within said bowl, said nozzles being arranged to direct a jet of water and cleaning product at predetermined areas.

11. The apparatus of claim 1 wherein a tank of disinfecting product is provided and a refill tank is located above said tank;

sensors having lights to indicate readiness of the apparatus;

said lights indicating the that tank is empty.

12. The apparatus of claim 11 wherein a sensor is associated with a light to signal that the tank is empty, and said sensor is connected to said motor for said driving chains to prevent operation when said tank is empty.

13. The apparatus of claim 1 wherein a flow regulator is provided on the water feed pipe of the flushing tank.

14. The apparatus of claim 13 equipped with a manual control lever.

15. The apparatus of claim 1 wherein an element is provided to detect the presence of a person close to the apparatus to prevent operation of the apparatus.

16. The apparatus of claim 15 wherein the detector comprises an optoelectronic cell.

17. The apparatus of claim 15 wherein the detector comprises an element sensitive to the closing of the inside lock of the door controlling access to the apparatus.

18. The apparatus of claim 15 wherein the detector is connected to the control circuit of the apparatus to control the starting of the operation cycle.

* * * * *